US006187371B1

(12) United States Patent
Davies et al.

(10) Patent No.: US 6,187,371 B1
(45) Date of Patent: Feb. 13, 2001

(54) PRODUCTION OF FAMILIAL, NON-MODULAR, PLURAL COLOR PATTERNS ON A MOVING SUBSTRATE

(75) Inventors: Mark John Davies; Trevor James Horton, both of Albion Park (AU)

(73) Assignee: BHP Steel (JLA) Pty. Ltd., New South Wales (AU)

( * ) Notice: Under 35 U.S.C. 154(b), the term of this patent shall be extended for 0 days.

(21) Appl. No.: 09/147,848

(22) PCT Filed: Oct. 13, 1997

(86) PCT No.: PCT/AU97/00684

§ 371 Date: Mar. 19, 1999

§ 102(e) Date: Mar. 19, 1999

(87) PCT Pub. No.: WO98/16325

PCT Pub. Date: Apr. 23, 1998

(30) Foreign Application Priority Data

Oct. 14, 1996 (AU) ..... PO2954

(51) Int. Cl.[7] ..... B05D 5/06; B05D 1/40

(52) U.S. Cl. ..... 427/11; 427/262; 427/263; 427/280; 427/281; 427/365

(58) Field of Search ..... 427/262, 263, 427/258, 11, 280, 281, 186, 365; D19/36, 41; 401/52, 35

(56) References Cited

U.S. PATENT DOCUMENTS

| | | | | |
|---|---|---|---|---|
| 3,816,155 | * | 6/1974 | Iverson et al. | 117/10 |
| 3,887,287 | * | 6/1975 | Rosh, Jr. | 401/35 |
| 4,375,158 | | 3/1983 | Eichmanns et al. . | |
| 4,505,713 | | 3/1985 | Eichmanns et al. . | |
| 4,602,886 | * | 7/1986 | Smit | 401/35 |
| 4,743,471 | | 5/1988 | Shills, III . | |
| 5,099,534 | | 3/1992 | Annen et al. . | |

FOREIGN PATENT DOCUMENTS

| | | |
|---|---|---|
| 41527/92 | 1/1994 | (AU) . |
| B-41527/93 | 1/1994 | (AU) . |
| 0 494 672 | 7/1992 | (EP) . |

OTHER PUBLICATIONS

Derwent Abstract Accession No. 93–070353/09, Class P42, JP 05–01839A (Nippon Steel Corp.), Jan. 26, 1993.
Derwent Abstract Accession No. 91–114363/16, Class P42, JP 03–056174 A (Matsushita Elec. Works), Mar. 11, 1991.
Derwent Abstract Accession No. 60653X/32, Class A32, JP 51–073037 A (Shinto Paint KK) Jun. 24, 1976.
Derwent Abstract Accession No. 17023Y/10, Class A32, JP 52–009038 A (Kansai Paint KK) Jan. 24, 1977.
Derwent Abstract Accession No. 69270B/38, Class M13, JP 79–025538 A (Daido Kohan KK (NIPA)) Aug. 29, 1979.
DE 2834180 A (HPW Herzberger Plattenwerke GmbH & Co KG) Feb. 21, 1980, p. 8 line 13.

* cited by examiner

*Primary Examiner*—Fred J. Parker
*Assistant Examiner*—Kirsten A. Crockford
(74) *Attorney, Agent, or Firm*—Miles & Stockbridge P.C.; John C. Kerins

(57) ABSTRACT

A method of continuously producing a continuous paint coat of substantially constant, pre-determined thickness, and displaying a plural colour, familial, non-modular pattern, on a surface of a moving substrate, comprising the steps of depositing at least two discontinuous, randomly patchy, differently coloured, component paint deposits, at a predetermined, constant, long term deposition rate for each component deposit in terms of the volume of paint per unit area of the surface, within a single stationary target area of the surface, or within stationary target areas of the surface respectively associated with the component deposits and at least partly aligned in the direction of movement of the substrate, and thereafter spreading and smoothing the component paint deposits carried by the substrate from the target area or areas, to form the continuous coat.

12 Claims, 11 Drawing Sheets

PRODUCTION OF FAMILIAL, NON-MODULAR, PLURAL COLOR PATTERNS ON A MOVING SUBSTRATE

TECHNICAL FIELD

This invention relates to the continuous application of liquid or semi-liquid paint coatings to a moving substrate.

The invention was devised primarily for the application of coatings of paint to metal strip, for example steel strip coated with a corrosion resistant metallic alloy, and is described primarily in that context hereinafter. However it will be apparent that it is applicable to the application of paint coatings to substrates of other materials, provided the substrate is substantially impervious to the coating and, at least in preferred embodiments of the invention, is capable of being heated to above the glass transition temperature of a solid paint composition to be applied to the substrate.

BACKGROUND ART

The application of paint to steel strip in large scale, continuously operating, steel finishing mills is a highly developed art.

Typically, the substrate strip is progressed through a coating station wherein liquid paint, comprising pigments and other paint solids dissolved in a solvent or otherwise dispersed in a liquid carrier, is applied to the substrate by a dipping, spraying, roller coating or like process for applying a liquid film to the substrate, which film is subsequently allowed or caused to evaporate to leave a solid paint coat on the substrate.

It is also known to apply paint composition to a heated substrate wherein the paint is applied as a liquid melted from a solid body of substantially solvent free paint composition by contact of the body with, or near approach of the body to, the hot substrate. In this context the term "liquid" includes high viscosity liquids, that may approach soft, plastic solids in nature, as well as easily flowing liquids.

That last mentioned mode of depositing liquid material on a substrate is referred to as "melt deposition" and the deposited liquid is referred to as a "melt deposit" hereinafter.

Previously the deposition rate of melt deposits was determined by controlling the contact pressure between the solid paint body and the substrate, while maintaining constant all of the many other parameters affecting the deposition rate. Such a process is described in U.S. Pat. No. 3,630,802 to Dettling.

The difficulty of accurately controlling all of those parameters makes it difficult to obtain constant deposition rates of low value when using Dettling type pressure controlled melt deposition processes. This lead to their replacement, in painting operations, by the melt deposition technique described in our Australian patent No. 667716.

Briefly stated, that Australian patent discloses depositing a polymer based coating composition onto a side of a substrate metal strip moving at a constant speed, by heating the strip to a temperature above the glass transition temperature of the composition, and driving a solid block of the composition towards the strip at a predetermined block speed.

It is then only necessary to control the block speed to cause a melt deposit to be applied to the strip at a precisely controlled deposition rate, without the need to closely control other operating parameters, in that each of those other parameters need only lie within a broad range of working values.

As is also disclosed in that Australian patent, the melt deposit may then be spread over the surface of the strip by a pressure roll to emerge as a smooth, wet coating on the strip.

Irrespective of the mode of deposition, the prior art has been restricted to the production of mono-chrome product, wherein a uniform coating is applied to the whole of at least one side of the substrate strip.

DISCLOSURE OF THE INVENTION

An object of the present invention is to provide ornamental, plural colour paint coatings, wherein the differently coloured components of the coating are applied during a single pass of a substrate through a painting station.

It is well known that some patterns displaying random variation, in the sense that no repeating module of the pattern may be discerned, may, nevertheless, be seen as being members of a family of related patterns, in the sense that individual expressions of the randomly variable patterns of one family have a recognisable family similarity, enabling them to be readily distinguished, by eye, from individual expressions of the randomly variable patterns of other families.

Wood grain patterns may be cited as typical examples of patterns of the kind referred to in the preceding paragraph. One has no difficulty in distinguishing between veneers of, for example the four "families" of leak, pine, mahogany, and silky oak, although no two pieces of veneer of any one timber are identical.

Such randomly variable patterns maintaining a family resemblance are referred to as "familial, non-modular patterns" hereinafter.

The concept of familial, non-modular patterns is of significance to the present invention. If, for example, a domestic appliance has a cabinet made of panels of plural coloured, painted sheet steel, it is desirable that there be no discernible repetition of the pattern in any one panel or from panel to panel of the appliance, but it is also desirable that each panel bears a strong family resemblance to the others.

Thus, another object of the present invention is to provide for the continuous application of a paint coat displaying a familial, non-modular, colour pattern to a substrate, during a single pass of the substrate through a painting station.

Still another object is to provide for the reproducibility of the family likeness of familial coatings produced by painting operations that may be spaced apart in time.

Meeting that last objective enables a steel finisher, for example, to accept orders for painted strip identified by reference to a familial, non-modular coating illustrated in a catalogue, in the knowledge that he may produce new product that may never display an exact reproduction of the catalogue illustration, but which will nevertheless be regarded by the purchaser as an acceptable expression of the catalogue illustration.

The present invention is based on the experimentally determined discovery that if two or more differently coloured paints are applied as discontinuous, randomly patchy deposits to a stationary target area of a moving substrate, or respectively to stationary target areas that are aligned in the direction of travel of a substrate, then, provided the long term deposition rates, in terms of the volume of the deposit per unit area of the substrate surface that is to be painted, is appropriately chosen and closely controlled, those deposits may be spread and smoothed to form a continuous coat of desired thickness covering a larger area of the substrate surface and displaying a familial, non-modular striated pattern. Surprisingly, even if the paints are similar in composition and are readily miscible, it has been found that the respective colours remain visible as distinct colours in the continuous coat.

Furthermore, the experiments leading to the present invention have shown that if the individual long term deposition rates of the component deposits and the positioning of the target area or areas for each component deposit are reproduced from one operation to another, then the non-modular pattern resulting from each operation will display an unchanging family resemblance. On the other hand, if any one or more of those deposition parameters is changed, the resultant continuous coat will be discerned as belonging to another family.

As of now, the particular family characteristics of any selection of those parameters cannot be readily forecast in advance, and it is necessary to trial any particular selection to determine whether it will produce a pleasing result. However experiments have conclusively demonstrated that the family character of any selection will be reproduced by the same selection on each different occasion.

Therefore, the invention consists in a method of continuously producing a continuous paint coat of substantially constant, pre-determined thickness, and displaying a plural colour, familial, non-modular pattern, on a surface of a moving substrate, comprising the steps of depositing at least two discontinuous, randomly patchy, differently coloured, component paint deposits, at a predetermined, constant, long term deposition rate for each component deposit in terms of the volume of paint per unit area of the surface, within a single stationary target area of the surface, or within stationary target areas of the surface respectively associated with the component deposits and at least partly aligned in the direction of movement of the substrate, and thereafter spreading and smoothing the component paint deposits carried by the substrate from the target area or areas, to form the continuous coat.

As the component deposits are discontinuous and patchy their instantaneous deposition rates are constantly varying, thus the term "long term deposition rate" is used herein to indicate the average rate when taken over an area of the substrate surface large enough to ensure that an equivalent steady state figure is determined. Typically, the total volume of a component deposited on say, 0.5 to 1.0 square meters of the substrate surface may be regarded as the component's "long term" deposition rate.

The invention is not limited to a particular mode of deposition of the component deposits provided they meet the above criteria, however in preferred embodiments of the present invention a melt deposition process, using constant substrate speed and controlled block speed, of the kind described above, is used in respect of each component deposit.

It has been found that if the block speed is low enough, the melt deposit is in the form of relatively thick, randomly positioned gobbets of paint. Thus melt deposition using block speed control is ideal for the purposes of the present invention, in that notwithstanding the randomly patchy nature of the melt deposit, the long term deposition rate on a constant speed substrate is still accurately determined by the block speed.

Also, the target area for a deposit, being the area of the block to substrate interface, is accurately defined, and fully blanketed in the long term by the deposited material. Thus, if the strip speed is constant, melt deposition using block speed control may provide all the above described characteristics of a component deposit as that term is used herein, namely a randomly patchy deposit applied to a moving substrate at an accurate long term rate, in terms of volume of paint deposited per unit area of the substrate surface, applied within a predetermined stationary target area of the substrate surface.

Therefore according to a first preferred embodiment, the invention provides a method of painting at least a part of a side face of a moving substrate strip utilising a paint composition having a glass transition temperature, of the kind comprising the steps of pre-heating the strip to a pre-heat temperature above said glass transition temperature, moving the pre-heated strip at a pre-determined strip speed, driving a solid block of the paint composition along an axis of the block at a pre-determined block speed towards said side face to cause a liquid deposit of said paint composition to be melted from the block and carried away from the block on said face, spreading and smoothing the carried away liquid deposit, and thereafter allowing or causing the smoothed liquid deposit to solidify, characterised in that said block comprises at least two differently coloured components, in that the pre-heat temperature is above the glass transition temperatures of all of the components, in that the block speed is so low as to ensure that the carried away deposit is a discontinuous patchy deposit, and in that the spreading and smoothing converts the discontinuous patchy deposit into a continuous coat displaying a familial, non-modular colour pattern.

According to a second preferred embodiment the invention provides a method of painting at least a part of a side face of a moving substrate strip utilising a paint composition having a glass transition temperature, of the kind comprising the steps of pre-heating the strip to a pre-heat temperature above said glass transition temperature, moving the pre-heated strip at a predetermined strip speed, driving a solid block of the paint composition along an axis of the block at a pre-determined block speed towards said side face to cause a liquid deposit of said paint composition to be melted from the block and carried away from the block on said face, spreading and smoothing the carried away liquid deposit, and thereafter allowing or causing the smoothed liquid deposit to solidify, characterised in that at least one further said block at least partly differing in colour from the first mentioned block and in at least partial alignment with the first mentioned block in the direction of strip travel is likewise driven towards the side face at a second pre-determined block speed, which may or may not differ from the first mentioned block speed, in that each block speed is so low as to ensure that each of the carried away deposits is a discontinuous patchy deposit, and in that the spreading and smoothing converts all of the carried away deposits into a continuous coat displaying a familial, non-modular colour pattern.

BRIEF DESCRIPTION OF THE DRAWINGS

By way of example, several embodiments of the above described invention are described in more detail hereinafter with reference to the accompanying drawings.

BEST MODE OF CARRYING OUT THE INVENTION

Figure 2:
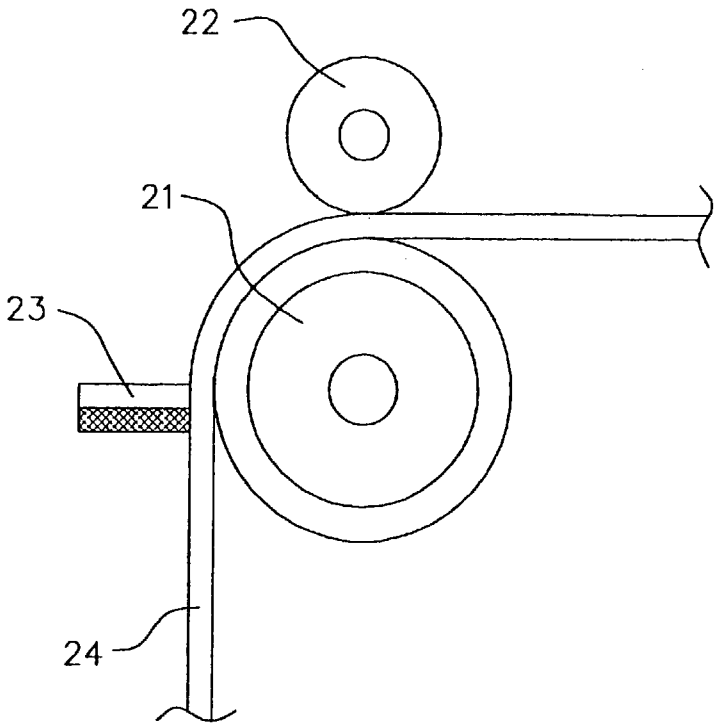
FIG. 2 is a diagrammatic sectional elevation taken on line A—A of FIG. 1.
Figure 1:
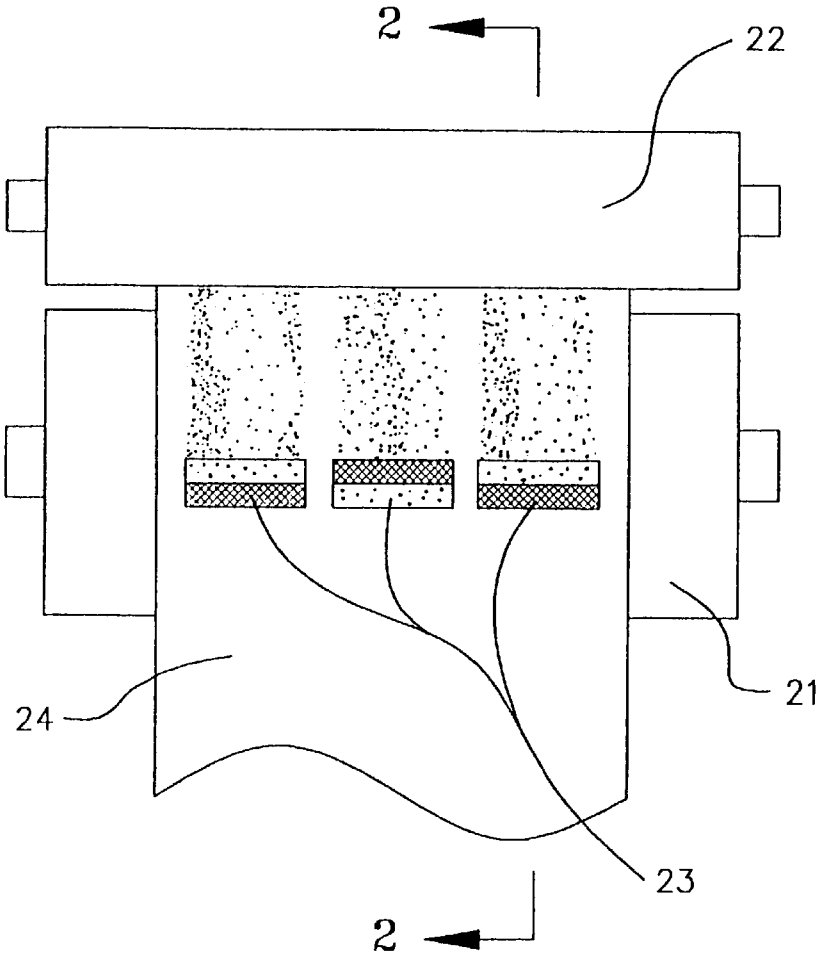
FIG. 1 is a diagrammatic front elevation of a painting station suitable for effecting methods according to the said first preferred embodiment of the invention.

The apparatus illustrated by FIG. 1 and 2, except for the nature of paint blocks 23 therein, is an essentially conventional melt deposition station, and need not be described in detail herein. It may be included as a component of a continuous paint line in a steel strip finishing mill. It comprises a steel back-up roll 21, a spreading and smoothing roll 22 with an elastomeric outer cylindrical surface layer and three paint blocks 23. Each paint block 23 comprises two or more component paint compositions of differing colours, as is described more fully below.

A steel strip 24 which is to be painted moves vertically upwardly towards the roll 21, turns through approximately 90 degrees as it passes over that roll and leaves the station more or less horizontally, having been passed through the nip of rolls 21 and 22. Both rolls are power driven and their surface speeds are not necessarily the same. The back-up roll 21 is preferably driven so that its surface speed is substantially the same as that of the strip 24, and that part of the roll touching the strip moves in the same direction as the strip. On the other hand the surface speed of the spreading and smoothing roll 22 may range between a slow speed in the opposite direction to the movement of the strip, through zero up to about 25% of the speed of the strip in the same direction as the movement of the strip. The speed of the strip 24 is kept constant and the paint blocks 23 are driven towards the strip by any appropriate speed controllable block feed device, for example, an endless belt conveyor carrying the blocks.

Before reaching the melt deposition station, the strip 24 is cleaned and otherwise readied to receive a paint coat. It is pre-heated to a temperature in excess of the glass transition temperatures of the component compositions of the blocks 23. Thus, paint composition is melted from the blocks 23 and deposited on the strip at a long term deposition rate determined by the block speed, and is carried by the strip to and through the nip of the two rolls 21 and 22.

In accordance with the invention, the block speed is so low as to ensure that the carried away melt deposit is a discontinuous patchy deposit, and a pressure is maintained between the rolls 21 and 22 that is sufficient to spread that melt deposit into a smooth, continuous coat of desired thickness preferably covering the side of the strip.

Also in accordance with the invention, each of the blocks 23 comprises at least two, unblended differently coloured components, and this, surprisingly, results in the continuous coat displaying a familial, non-modular pattern, in which, it has been found, the family resemblance is uniquely determined, in each instance, by the relative proportions and dispositions of the components in the blocks.

Figure 5:
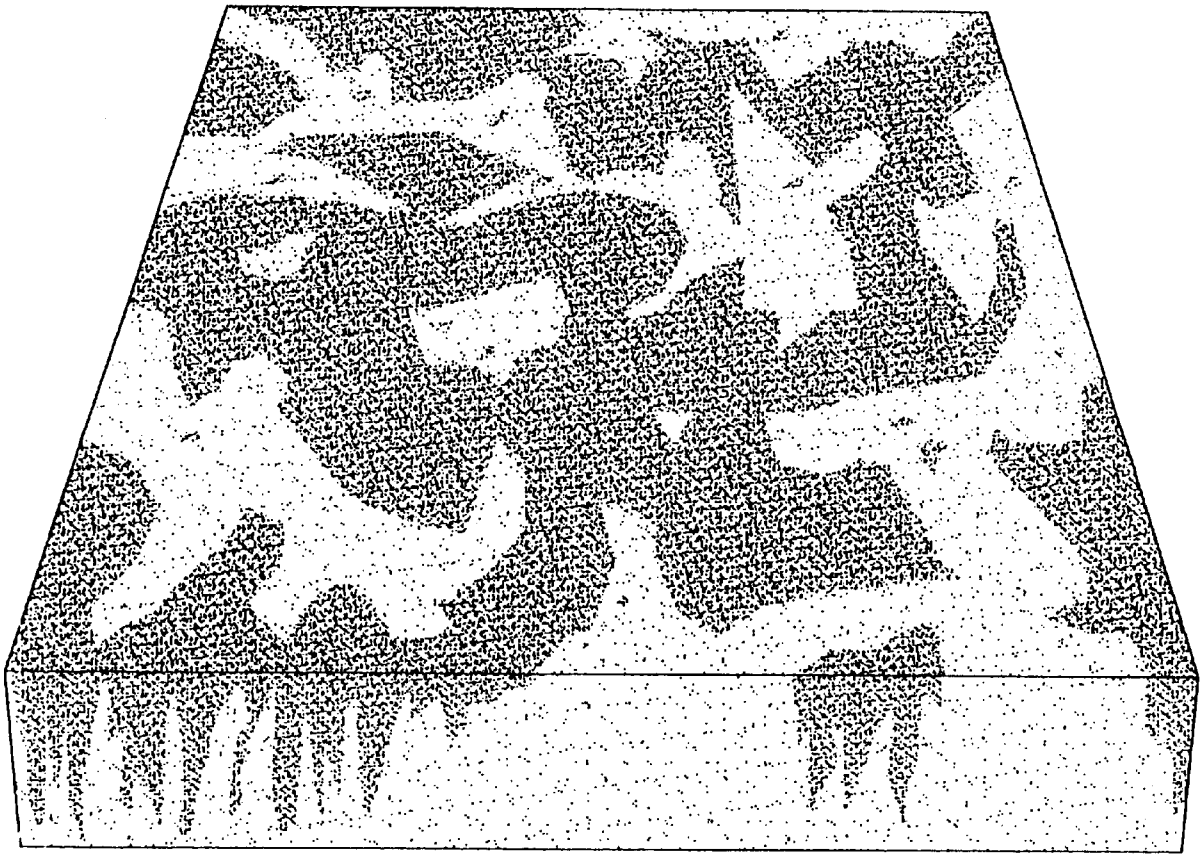
FIG. 5 is a perspective view of a two component paint block useable in methods according to said first or second preferred embodiments of the invention.
Figure 7:
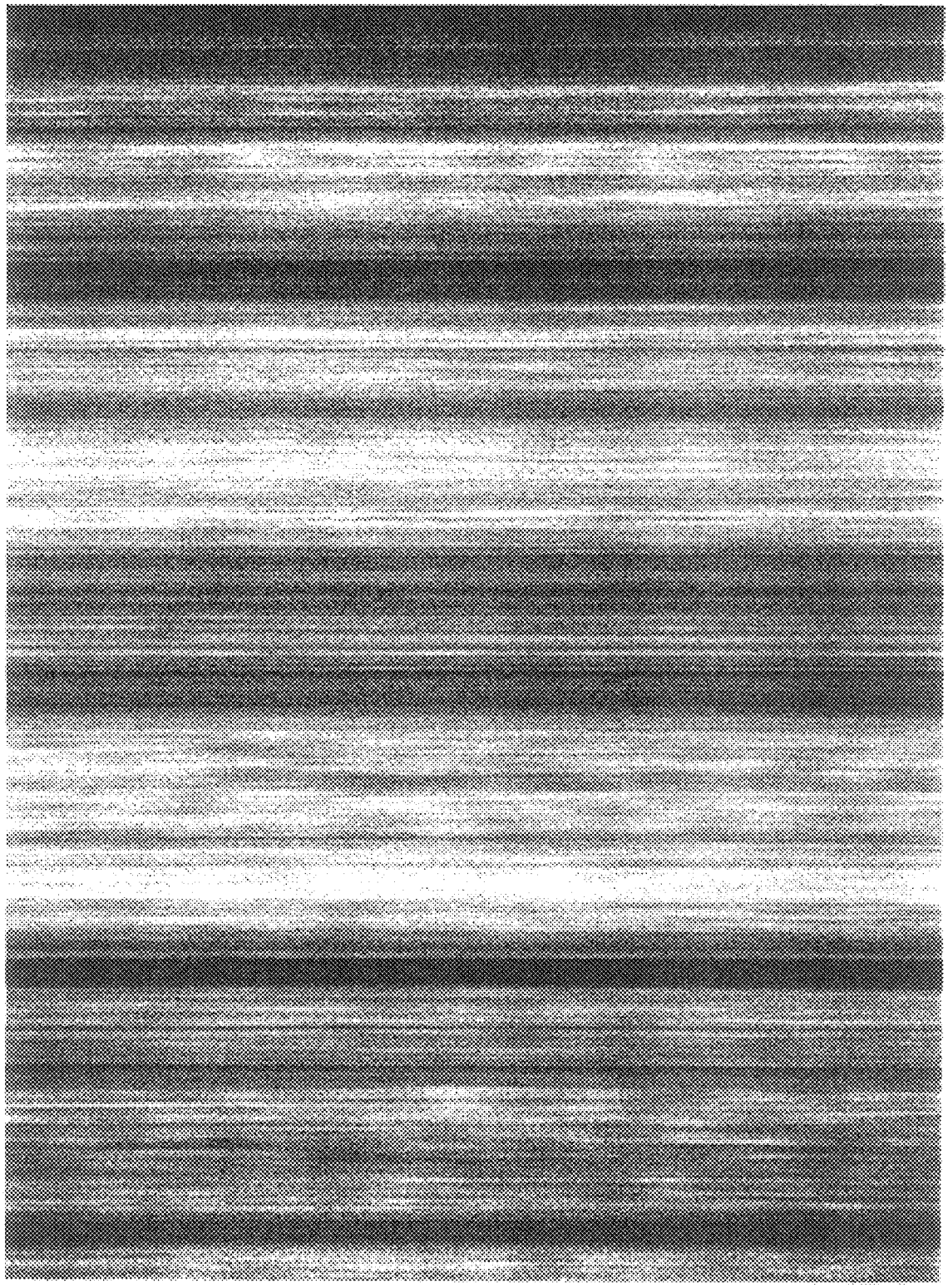
FIGS. 7, 8, 9 ,10, 11, 12, and 13 respectively are black and white depictions of familial, non-modular patterns on painted steel strip produced by exemplary embodiments of the invention.

For example, if each of the blocks 23 is a marbled block, such as illustrated by FIG. 5, wherein there is 17 parts by weight of the darker component to 13 parts by weight of the lighter component, a pattern exemplified by the sample length thereof shown by FIG. 7 is produced. The block of FIG. 5 is randomly marbled, it may be produced by placing appropriate quantities of large fragments of the solid components in a mould, and warming the mould and its contents sufficiently to cause the components to coalesce without mixing. The volume proportions of the components of the block may be selected as needed to produce different continuous coating patterns.

In other examples, a non-random arrangement of the block components may be obtained, for example by simultaneous extrusion of the warm components through a multi-orifice die, or multi nozzle extruder. Several such blocks, each of two components, are shown in FIGS. 6(*a*) to 6(*e*) respectively.

Figure 6:
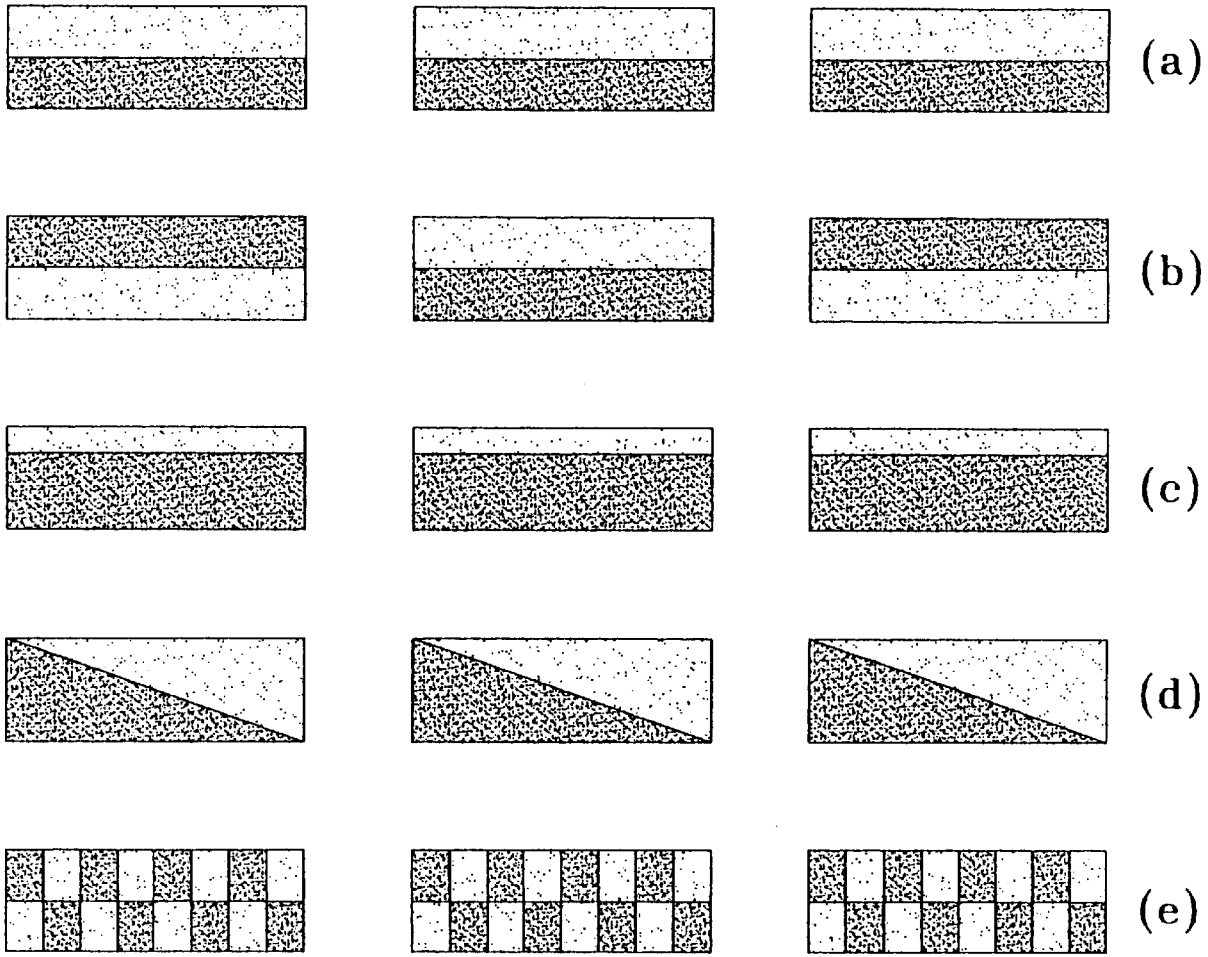
FIGS. 6(*a*), 6(*b*), 6(*c*), 6(*d*), and 6(*e*) are diagrammatic front elevations of sets of three, two component paint blocks useable in methods according to said first or second preferred embodiments of the invention.

It will be apparent that each of the multi component blocks illustrated by FIGS. 6(*a*) to 6(*e*) may be made as a unit, but alternatively the respective single coloured components may be laid up, one upon or beside the other, on a block feed conveyor to obtain the same effect. In this regard it should be borne in mind that the blocks are naturally adhesive to an extent enabling the laid up components to function as a single, plural coloured block.

It should be emphasised that the illustrated blocks are merely exemplary and there is an almost unlimited variety of similar blocks of two or more components, that could be used. All of the illustrated blocks, except for that of FIG. 6(*c*), show substantially equal volumes of each component in the finished block, but the actual proportions that may be used in any instance are purely a matter of choice, and determine the nature of the familial, non-modular pattern ultimately produced.

Figure 8:
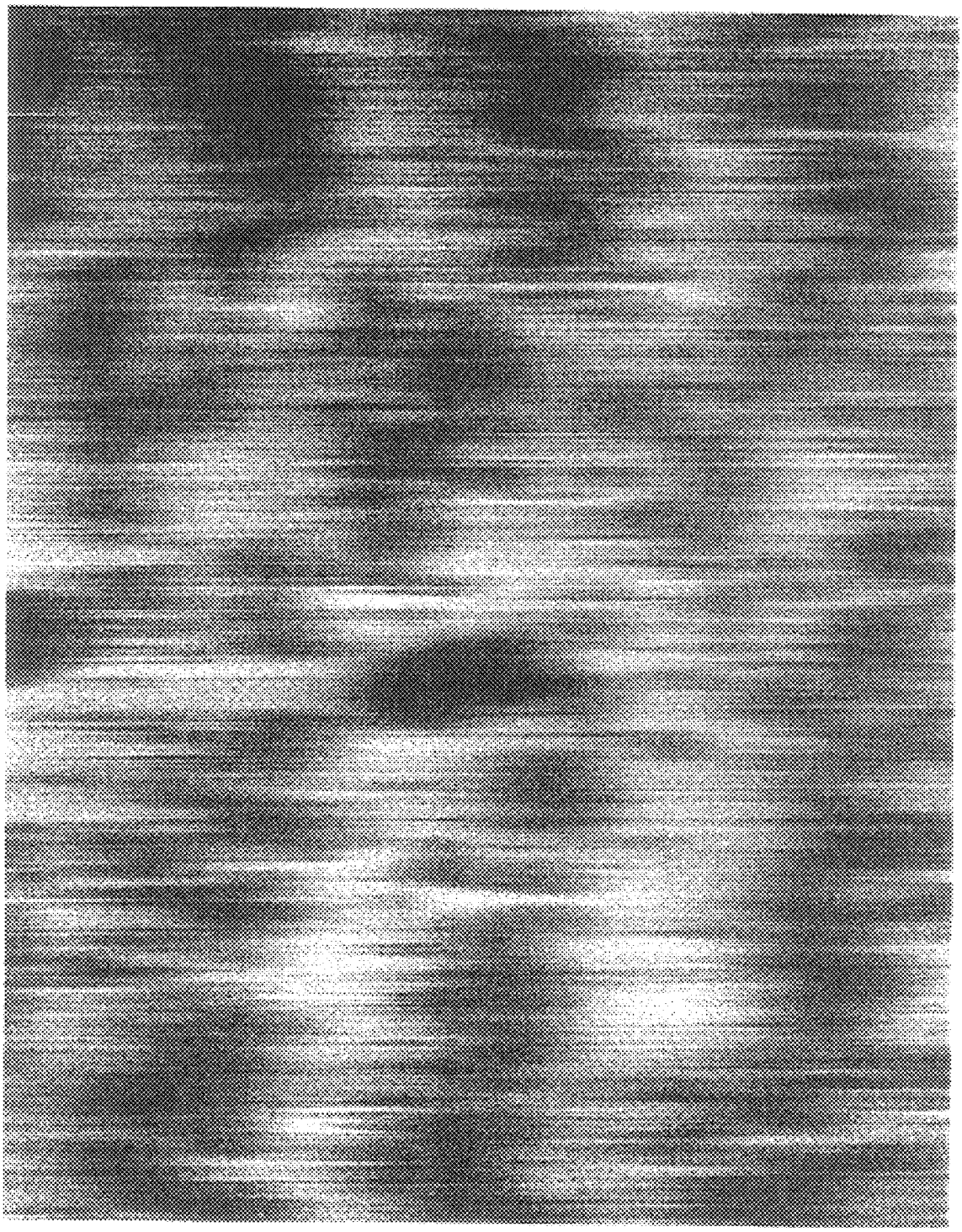
Figure 9:
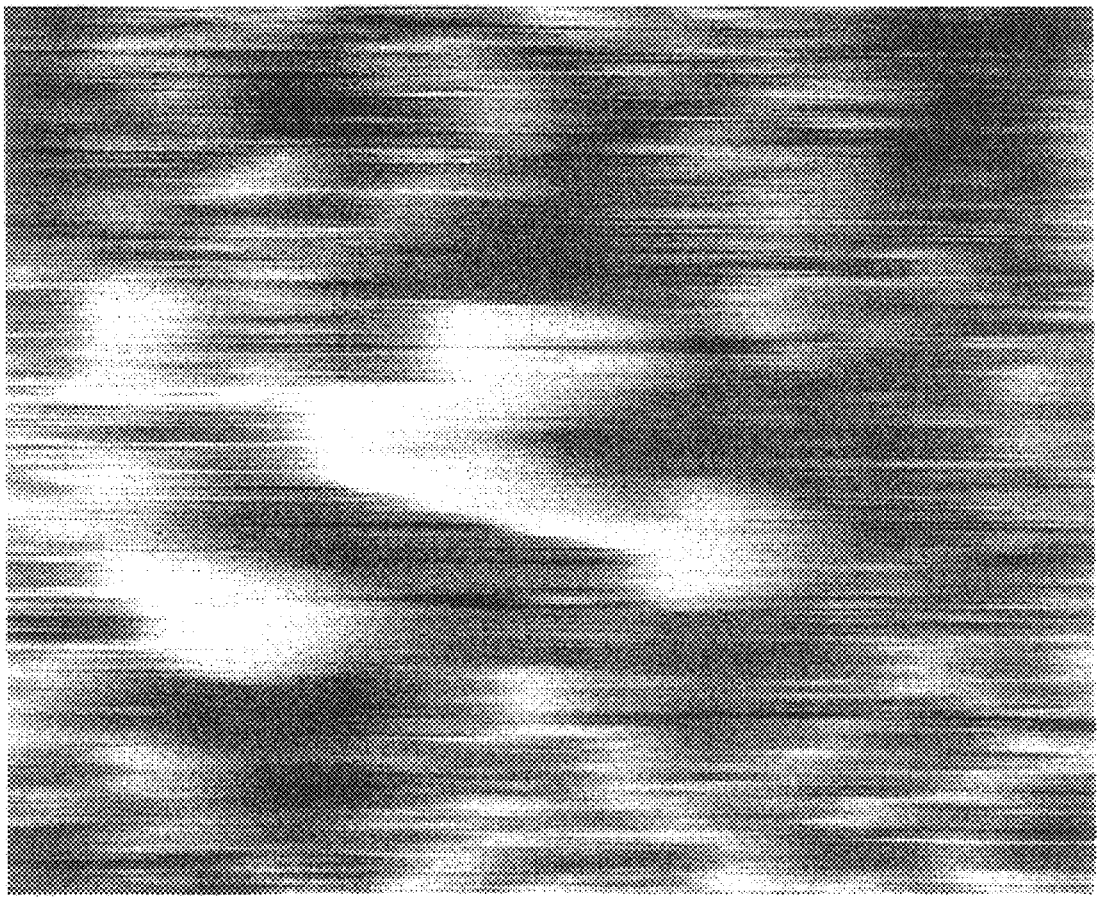

Again by way of example, reference is made to FIGS. 8 and 9, which demonstrate the dependency of the family resemblance of the finished pattern on the arrangement of the block components. FIG. 8 shows a sample pattern obtained when the blocks 23 conform with blocks 6(*a*) and when the lighter coloured layers of the blocks are the lower layers as the blocks are presented to the upwardly moving strip, whereas FIG. 9 shows the pattern produced by the same blocks when the lighter coloured layers are the upper layers. Somewhat surprisingly, the layer that is first met by the strip is dominant in the finished pattern, whereas one would intuit that the second met layer would dominate, as at times it would presumably be deposited on top of a patch of the first met layer.

Figure 4:
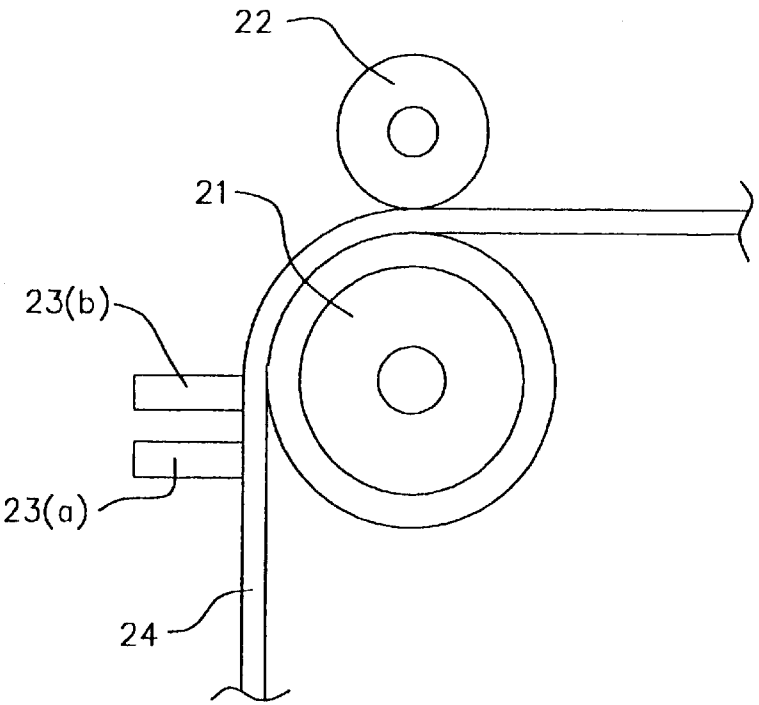
FIG. 4 is a diagrammatic sectional elevation taken on line A—A of FIG. 3.
Figure 3:
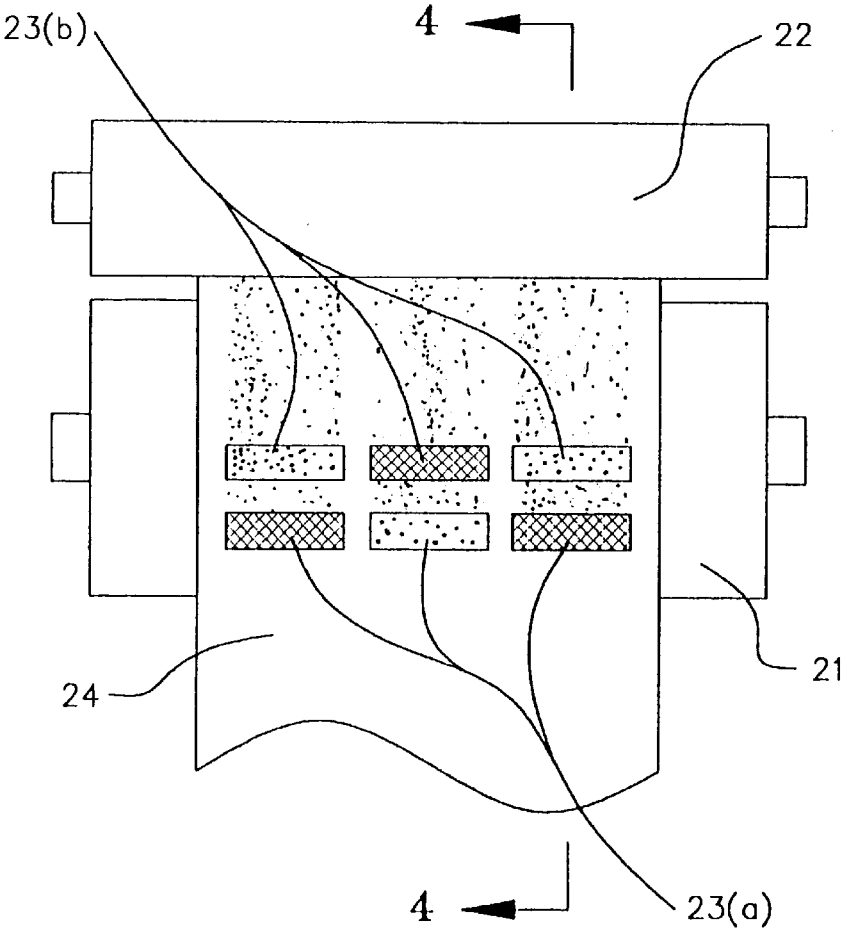
FIG. 3 is a view similar to FIG. 1 of a painting station suitable for effecting methods according to said second preferred embodiment of the invention.

FIGS. 3 and 4 show apparatus suitable for said second preferred embodiments of the invention. It differs from the FIGS. 1 and 2 apparatus only in that two independently controllable block feed devices are provided, for two sets of blocks 23(*a*) and 23(*b*) instead of the single feed device of the earlier described apparatus. Thus corresponding reference numerals are used in FIGS. 3 and 4 for corresponding parts in FIGS. 1 and 2, and they are not further described. This embodiment provides for more flexibility of operation, in that the deposition rate for each set of blocks may be selected by selecting the respective block speeds. Thus, in a two colour situation, if one wished the volume of one component deposit to be twice the volume of the other, one could use single colour, similarly sized blocks and feed one set at twice the speed of the other, whereas in the earlier described embodiment it would be necessary to manufacture blocks including the two components in the requisite proportions. Incidentally, it should be noted that the block speed directly determines the volume of the deposit. However, as the specific gravities of differently coloured pigments usually differ it follows that equal speeds of equally sized blocks will rarely produce equal masses of deposited components. As the effect on the eye may depend to some extent on the relative masses of pigment in the finished coating, the actual block speeds may have to be adjusted to suit. Therefore it is important that the sizes and weights of the blocks and the block speeds be recorded in any instance, to enable accurate pattern replication to be achieved at a later date.

The effect of varying the respective block speeds and dispositions is illustrated by FIGS. 10 to 13.

Figure 10:
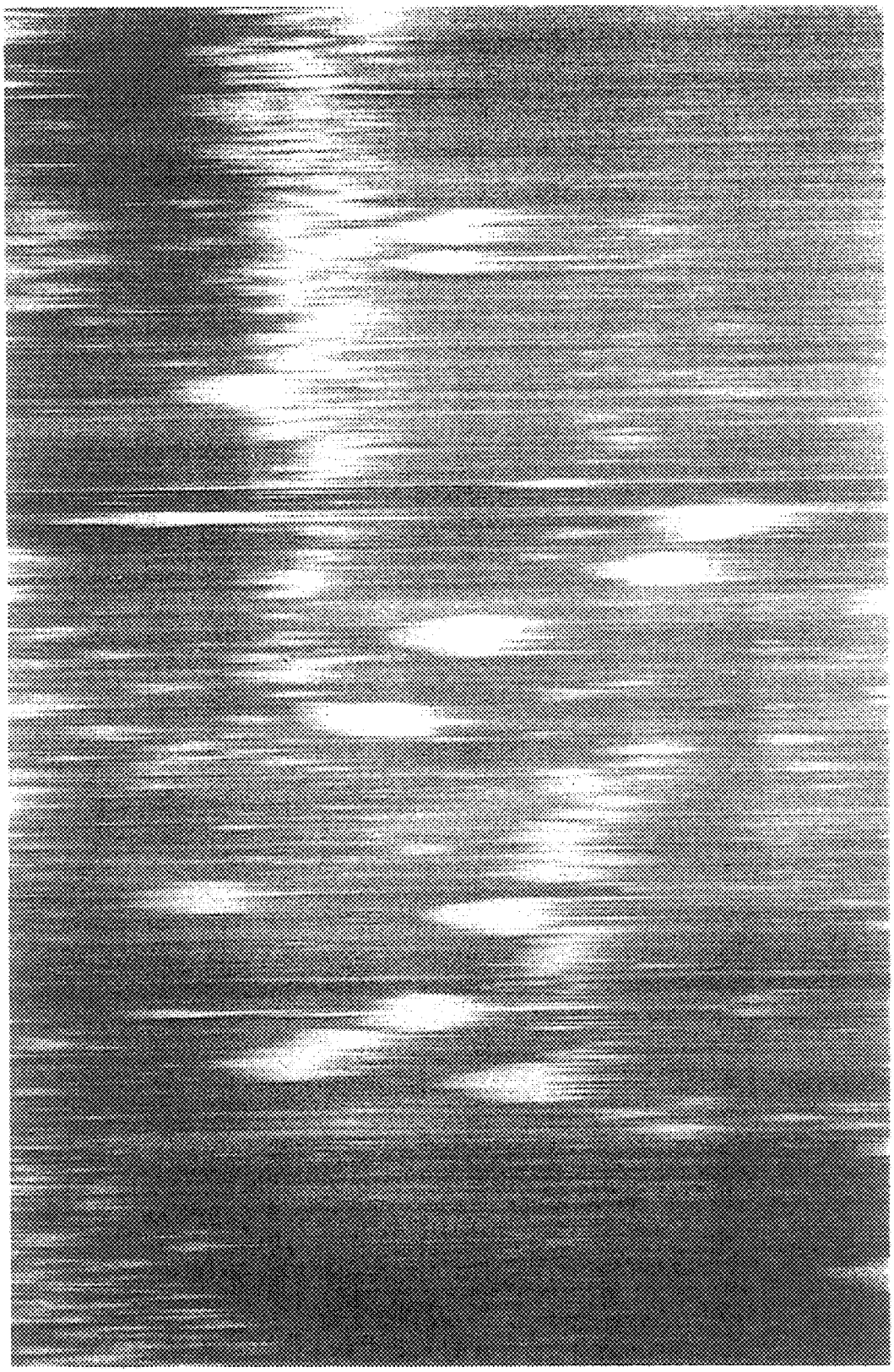

FIG. 10 shows a pattern produced when blocks 23(*a*) are the lighter blocks and the block speeds were selected so that the long term deposition rate of the lighter blocks 23(*a*) was approximately 70% of that of the darker blocks 23(*b*).

Figure 11:
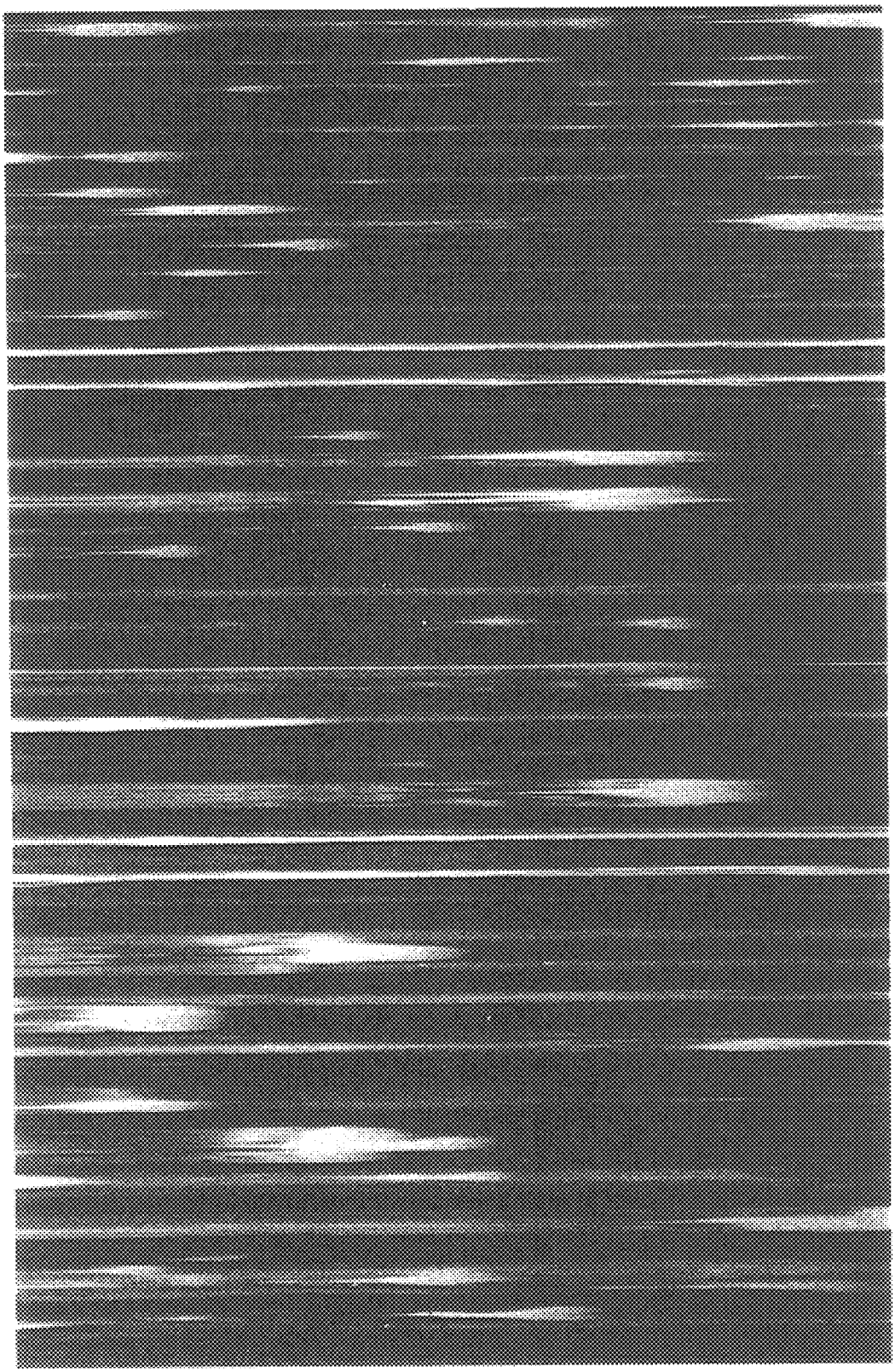

FIG. 11 shows the pattern produced under the same conditions as for FIG. 10 except that the deposition rate of the lighter blocks 23(*a*) was approximately 25% that of the darker blocks 23(*b*).

Figure 12:
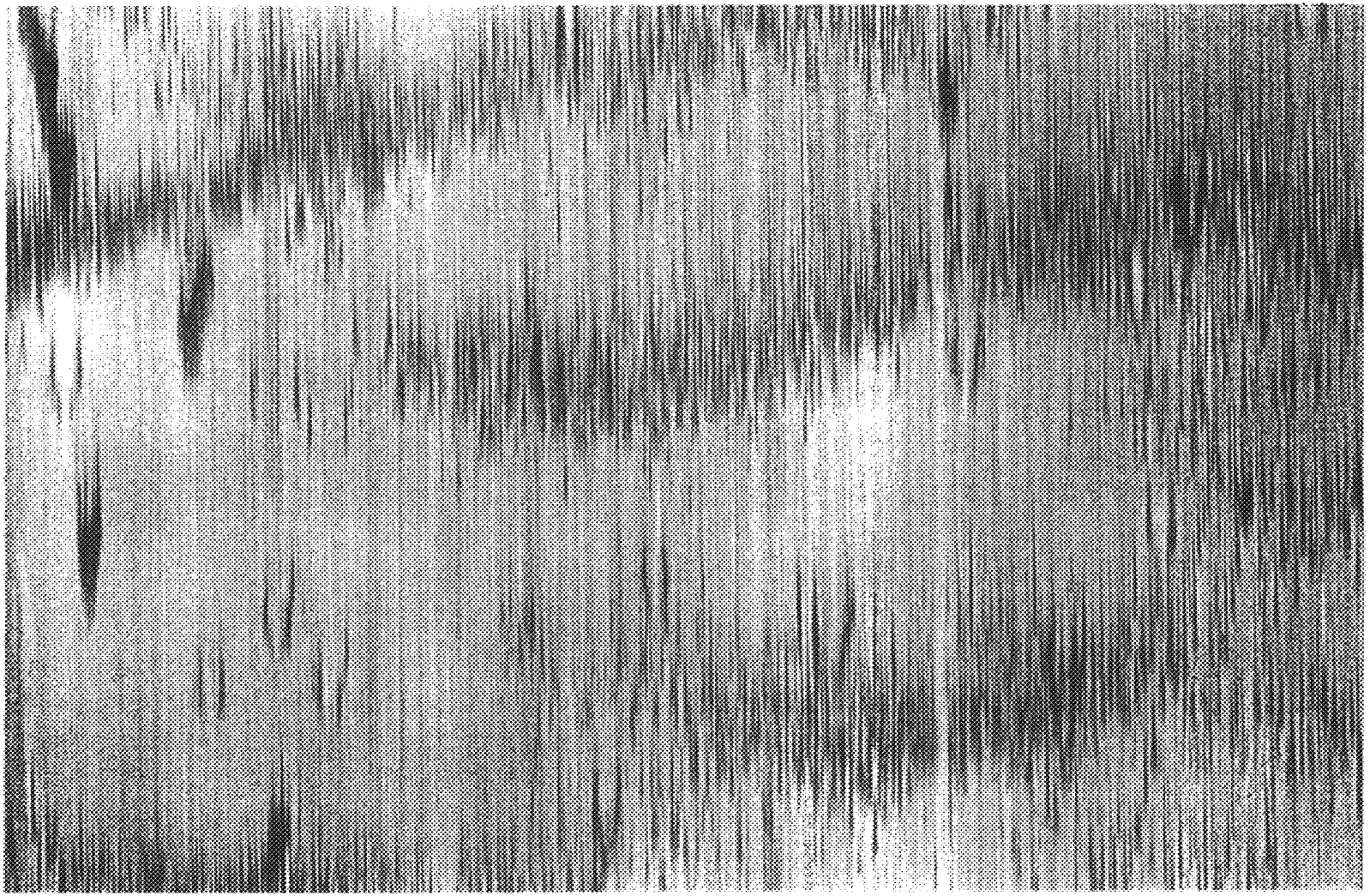

FIG. 12 shows the pattern when the lower blocks 23(*a*) were the darker and the long term deposition rate of those darker blocks was approximately 140% of that of the lighter blocks 23(*b*). The relative masses of the respective colours in this case is substantially the same as it was in the FIG. 10 example, but the effect on the eye is quite different.

Figure 13:
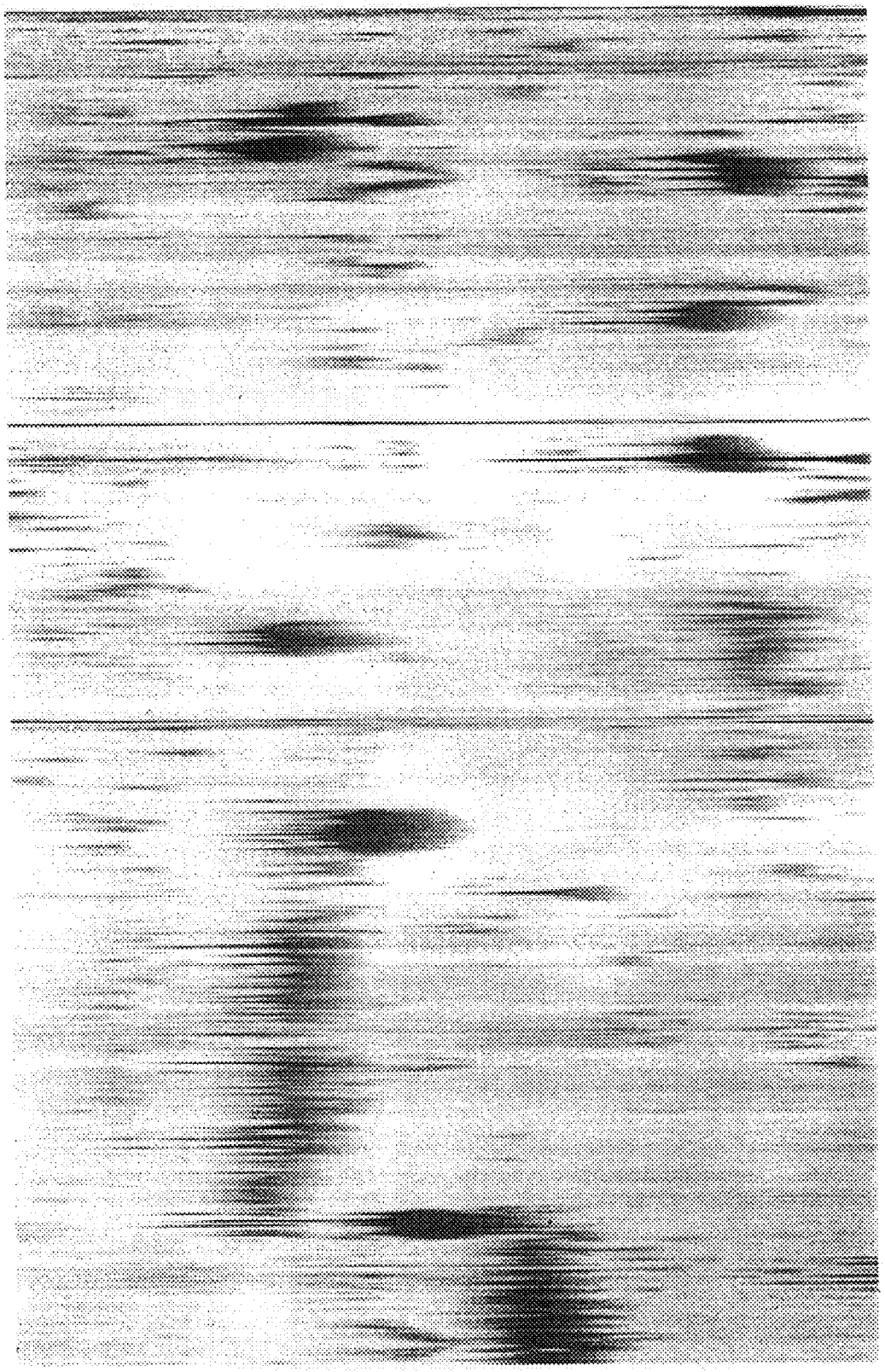

FIG. 13 shows the pattern when the lower blocks 23(*a*) were the darker and had a long term deposition rate of approximately 45% of that of the lighter blocks 23(*b*).

It will be noted that in each illustration, a row of three blocks is provided at each melt deposition site, so that the total target area in each case approximately spans the width of the strip. Such a span is preferred as it facilitates satisfactory spreading of the melt deposits into a continuous coat. It should also be noted, however, that this use of multiple blocks in rows (instead of a single block providing the same or similar span) provides for another variable in the selection of the finished pattern, in that the order of deposition of the components from each block of FIG. 1 or each aligned pair of blocks of FIG. 3 is not necessarily the same as for the neighbouring blocks in the row.

What is claimed is:

1. A method of continuously producing a continuous paint coat of substantially constant, pre-determined thickness, and displaying a plural colour, familial, non-modular pattern, on a surface of a moving substrate, comprising the steps of depositing at least two discontinuous, randomly patchy, differently coloured, component paint deposits, at a predetermined, constant, long term deposition rate for each component deposit in terms of the volume of paint per unit area of the surface, within a stationary target area of the surface and thereafter spreading and smoothing the component paint deposits carried by the substrate from the target area, to form the continuous coat having a familial, non-modular pattern.

2. A method of continuously producing a continuous paint coat of substantially constant, pre-determined thickness, and displaying a plural colour, familial, non-modular pattern, on a surface of a moving substrate, comprising the steps of depositing at least two discontinuous, randomly patchy, differently coloured, component paint deposits, at a predetermined, constant, long term deposition rate for each component deposit in terms of the volume of paint per unit area of the surface, within stationary target areas of the surface respectively associated with the component deposits and at least partly aligned in the direction of movement of the substrate, and thereafter spreading and smoothing the component paint deposits carried by the substrate from the target areas, to form the continuous coat having a familial, non-modular pattern.

3. A method according to claim 2 wherein the component deposit in each target area is of a single colour which is different from the single colour of the component deposit in at least one other target area.

4. A method of painting at least a part of a side face of a moving substrate strip utilising a paint composition having a glass transition temperature, of the kind comprising the steps of pre-heating the strip to a pre-heat temperature above said glass transition temperature, moving the pre-heated strip at a pre-determined strip speed, driving a solid block of the paint composition along an axis of the block at a pre-determined block speed towards said side face to cause a liquid deposit of said paint composition to be melted from the block and carried away from the block on said face, spreading and smoothing the carried away liquid deposit, and thereafter allowing or causing the smoothed liquid deposit to solidify, characterised in that said block comprises at least two differently coloured components, in that the pre-heat temperature is above the glass transition temperatures of all of the components, in that the block speed is so low as to ensure that the carried away deposit is a discontinuous patchy deposit, and in that the spreading and smoothing converts the discontinuous patchy deposit into a continuous coat displaying a familial, non-modular colour pattern.

5. A method according to claim 4 wherein the respective volumes of said components of the block are in pre-determined proportions.

6. A method according to claim 5 wherein the said components display a marbled pattern within the block.

7. A method according to claim 5 wherein each said component of the block is of constant cross-section on a section plane normal to the direction of movement of the block.

8. A method of painting at least a part of a side face of a moving substrate strip utilising a paint composition having a glass transition temperature, of the kind comprising the steps of pre-heating the strip to a pre-heat temperature above said glass transition temperature, moving the pre-heated strip at a pre-determined strip speed, driving a solid block of the paint composition along an axis of the block at a pre-determined block speed towards said side face to cause a liquid deposit of said paint composition to be melted from the block and carried away from the block on said face, spreading and smoothing the carried away liquid deposit, and thereafter allowing or causing the smoothed liquid deposit to solidify, characterised in that at least one further said block at least partly differing in colour from the first mentioned block and in at least partial alignment with the first mentioned block in the direction of strip travel is likewise driven towards the side face at a second pre-determined block speed, in that each block speed is so low as to ensure that each of the carried away deposits is a discontinuous patchy deposit, and in that the spreading and smoothing converts all of the carried away deposits into a continuous coat displaying a familial, non-modular colour pattern.

9. A method according to claim 8 wherein said first and second predetermined block speeds are equal.

10. A method according to claim 8 wherein each said block is of a single colour.

11. A method according to claim 8 wherein at least one of said blocks comprises at least two differently coloured components, and wherein the respective volumes of said components of said at least one block are in pre-determined proportions.

12. A method according to claim 11 wherein each said component of said at least one block is of constant cross-section on a section plane normal to the direction of movement of the block.

* * * * *